United States Patent [19]

Berman

[11] 4,427,391

[45] Jan. 24, 1984

[54] CONVERTIBLE DRAWING ARTICLE OF FURNITURE

[75] Inventor: Morton Berman, Brooklyn, N.Y.

[73] Assignee: Avalon Industries, Inc., Brooklyn, N.Y.

[21] Appl. No.: 315,540

[22] Filed: Oct. 27, 1981

[51] Int. Cl.[3] ..... A47B 41/04; B43L 5/02

[52] U.S. Cl. ..... 434/408; 108/26; 312/230; 434/420

[58] Field of Search ..... 108/25, 26; 312/230, 312/231; 434/81, 85, 88, 89, 408, 413, 414, 415, 416, 417, 418, 419, 420, 432

[56] References Cited

U.S. PATENT DOCUMENTS

| | | | |
|---|---|---|---|
| 115,349 | 5/1871 | Palm | 434/416 X |
| 1,200,071 | 10/1916 | Barler | 312/230 |
| 2,285,576 | 6/1942 | Fox . | |
| 2,397,405 | 3/1946 | Burkeman . | |
| 2,485,517 | 10/1949 | Vaule | 434/413 X |
| 2,672,391 | 3/1954 | Moore | 312/230 |
| 2,973,603 | 3/1961 | De Vincenzo . | |
| 3,168,363 | 2/1965 | Monsour . | |
| 3,180,288 | 4/1965 | McCowan . | |
| 4,127,948 | 12/1978 | Chin | 434/416 |

*Primary Examiner*—Harland S. Skogquist

*Attorney, Agent, or Firm*—Kirschstein, Kirschstein, Ottinger & Israel

[57] ABSTRACT

A convertible drawing article of furniture includes a support structure and a drawing board which can be mounted on the support structure in a prostrate position or in an upright position, so that the assembly can be used as a drawing desk or as an easel. The drawing board includes a mounting frame and a slate board which is supported on a circumferential recessed ledge of the frame and held thereon at its front corners by holding members. A compartmentalized tray is attached by compatible male and female connecting formations to the lateral section of the mounting frame in the prostrate position and to the front region of a support frame forming a part of the support structure in the upright position of the drawing board. The support structure further includes two front and two rear legs, of which the rear legs are telescopically extendable so that the drawing board can rest thereon in its upright position while its then lower section is engaged with rear projections of the tray. An embellishing accessory is mounted on the rear section of the drawing board in two possible orientations in one of which it extends substantially normal to, and in the other substantially along, the plane of the drawing board, by cooperating male and female attaching formations.

30 Claims, 19 Drawing Figures

FIG. 11
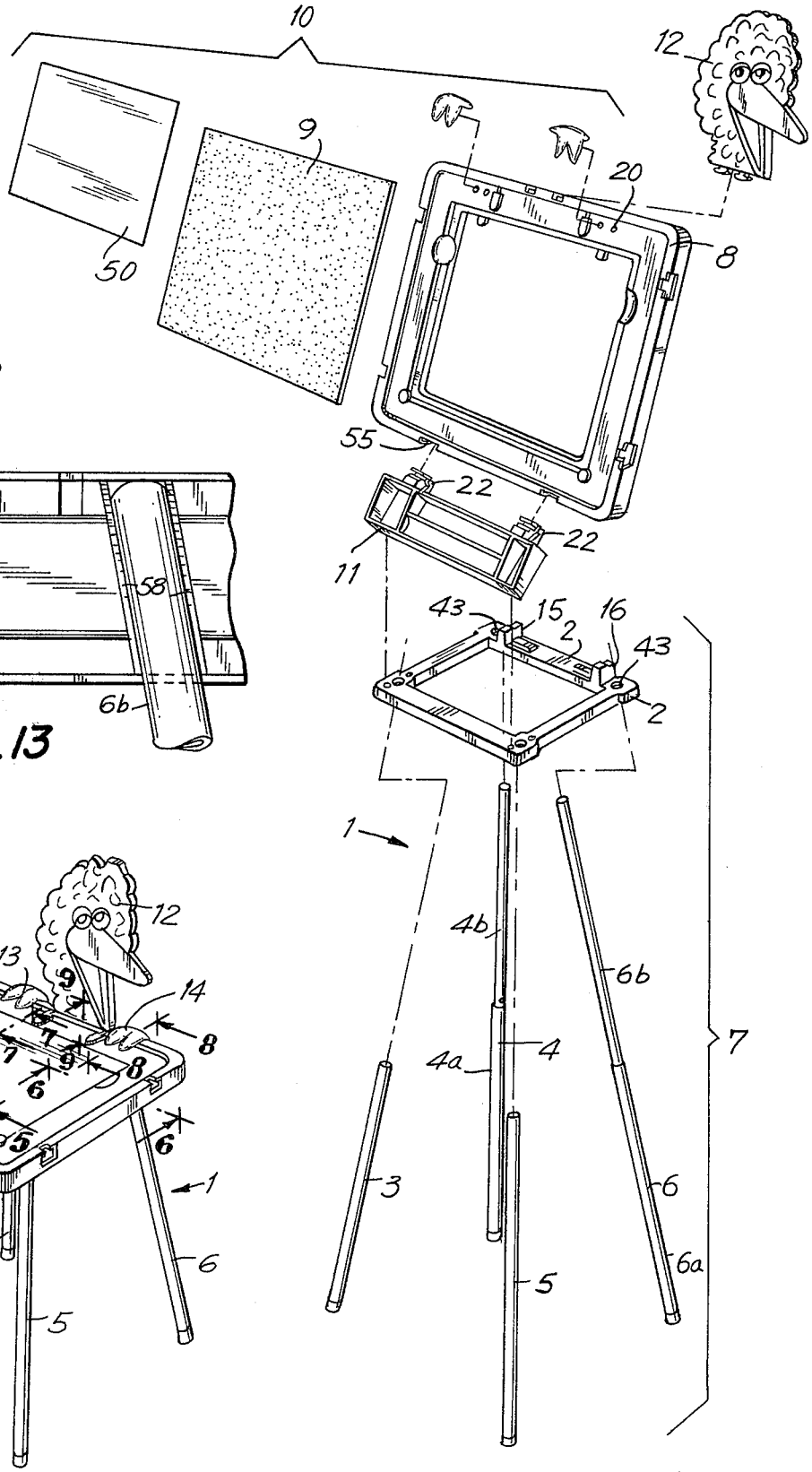
FIG. 12
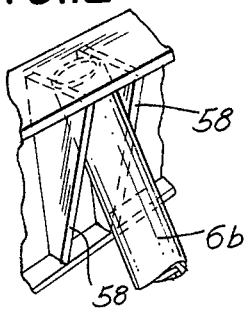
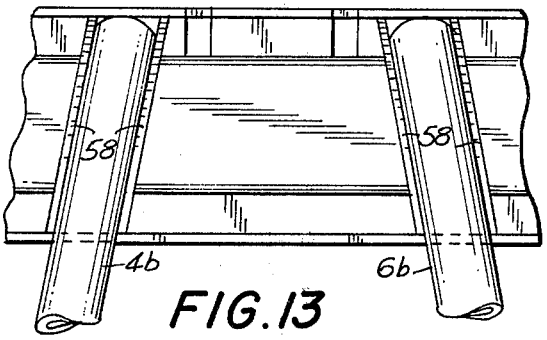
FIG. 13
FIG. 2
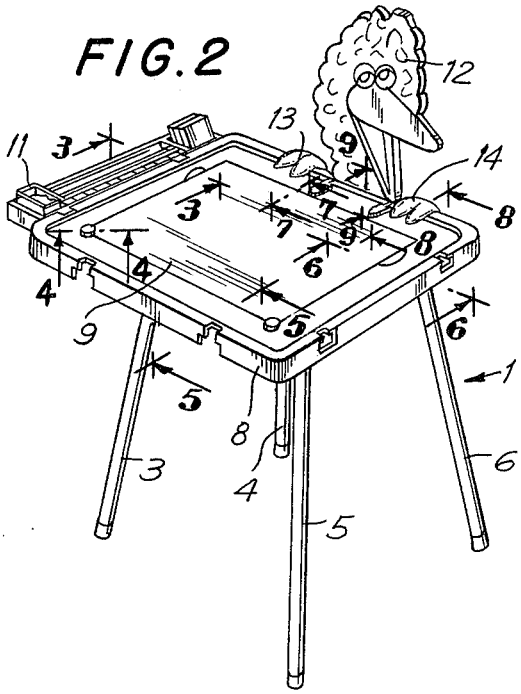

FIG. 3
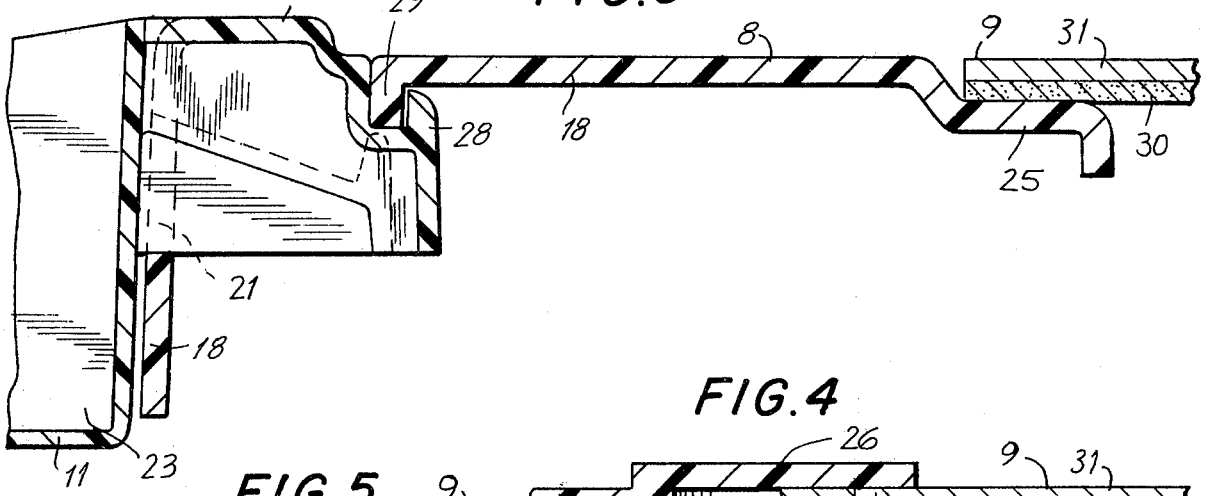
FIG. 4
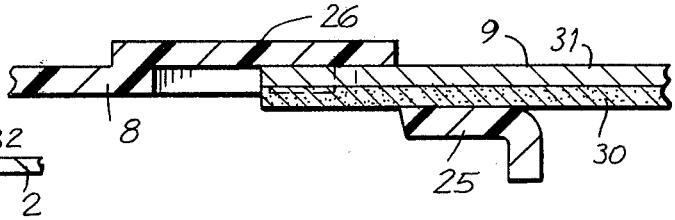
FIG. 5
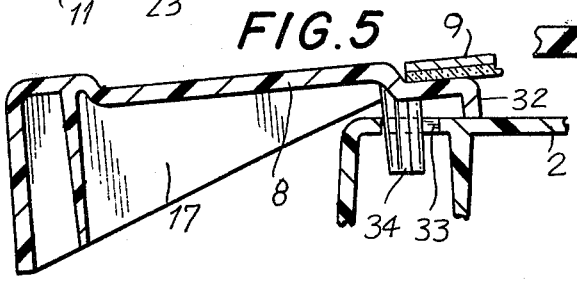
FIG. 6
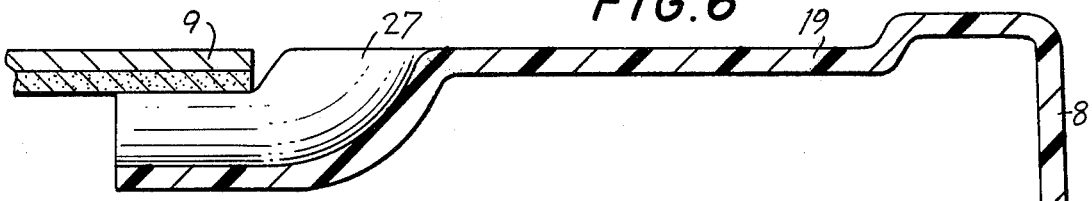
FIG. 7
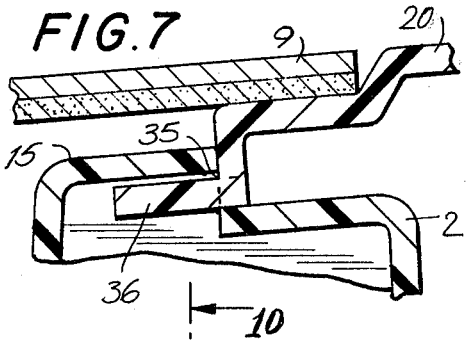
FIG. 8
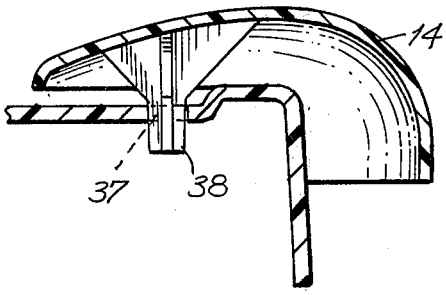
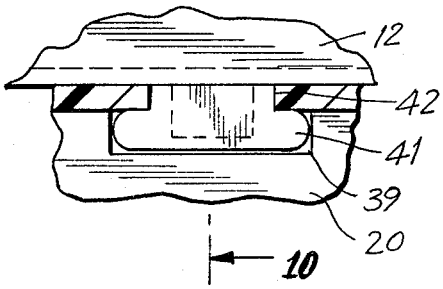
FIG. 9
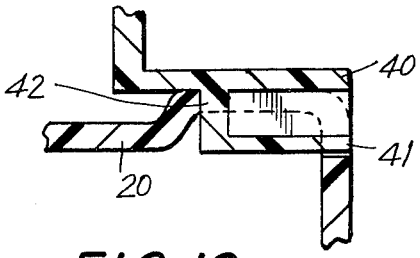
FIG. 10

FIG. 14
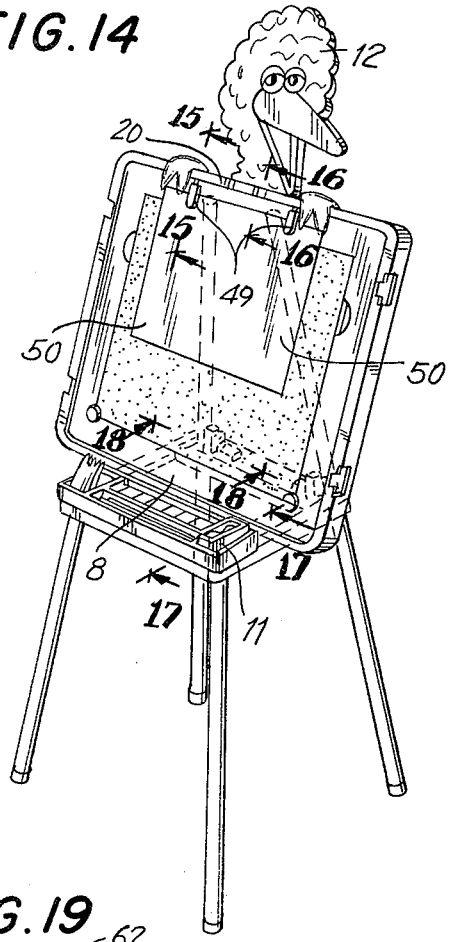
FIG. 15
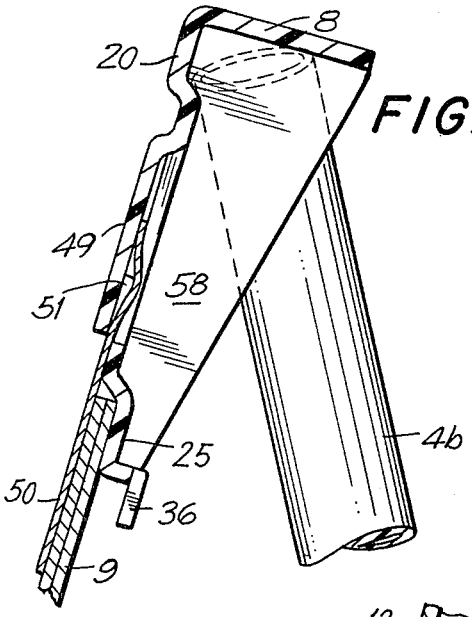
FIG. 16
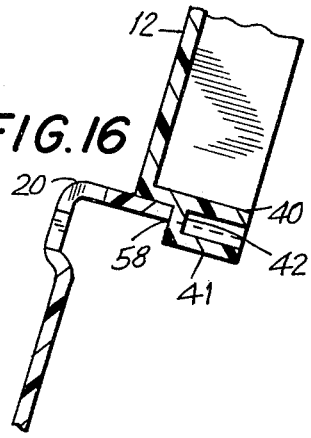
FIG. 19
FIG. 17
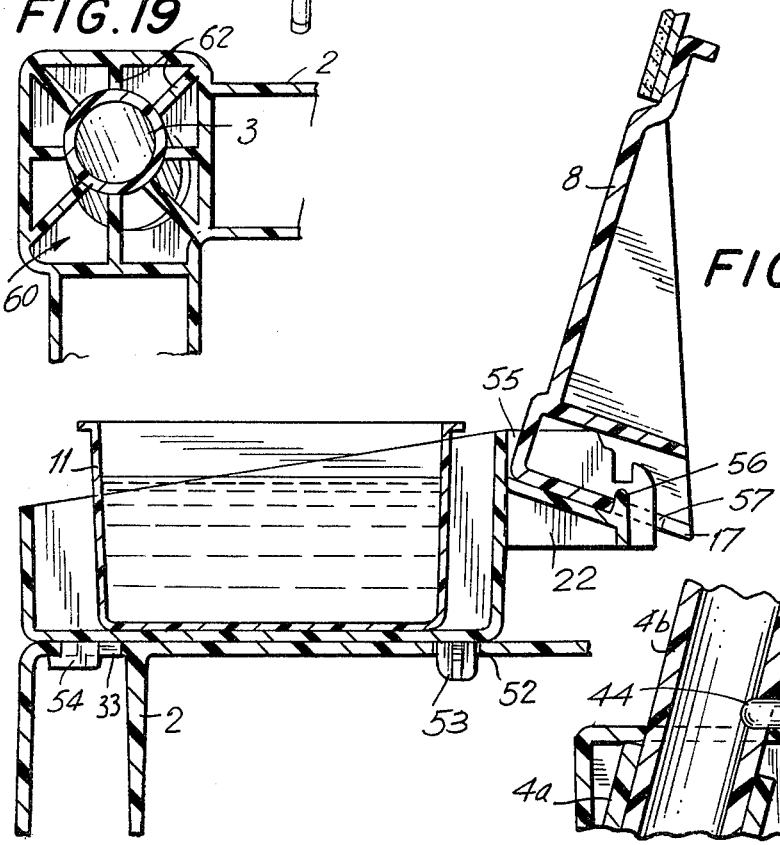
FIG. 18
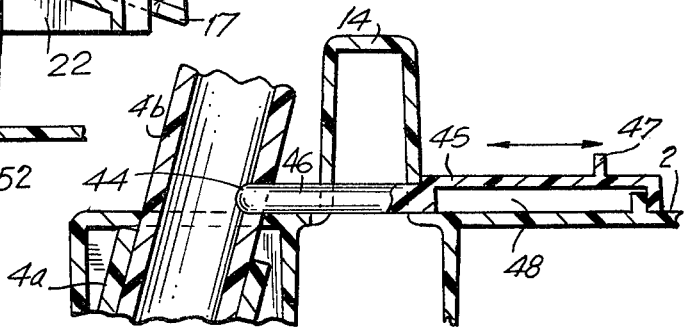

CONVERTIBLE DRAWING ARTICLE OF FURNITURE

BACKGROUND OF THE INVENTION

The present invention relates to articles of furniture in general, and more particularly to articles of furniture which are adapted to be written on, such as by chalk, or to serve as supports for sheets to be written or drawn or painted upon. Such articles of furniture will hereafter be referred to as drawing articles of furniture.

There are already known various constructions of drawing desks, some of them combined with seats or the like, and various constructions of easels capable of supporting, or equipped with, drawing boards. However, the conventional constructions leave much to be desired as to their use, versatility, compactness, sturdiness, and/or capability of being stored in a minimum space.

SUMMARY OF THE INVENTION

Accordingly, it is a general object of the present invention to avoid the disadvantages of the prior art.

More particularly, it is an object of the invention to provide a drawing article of furniture which is not possessed of the disadvantages of the conventional constructions of this type.

Still another object of the present invention is to so construct the article of furniture of the type here under consideration as to be convertible between a drawing desk and an easel with minimum effort.

It is still another object of the invention to so design the article of furniture as to be easily dismountable for storage purposes and to assume minimum space in its dismounted position, but to be quite sturdy in its mounted position.

It is a concomitant object of the present invention to develop a construction of the drawing article of furniture which will stay intact in its assembled position even if handled by a clumsy person.

An additional object of the present invention is to devise a construction of the drawing article of manufacture which is easy to manufacture and use, inexpensive, and reliable nevertheless.

In pursuance of these objects and others which will become apparent hereafter, one feature of the present invention resides in a convertible article of furniture comprising, in combination, a support structure including a support member, especially a support frame, extending along a plane and having a front and a rear region, two front legs mounted on the front region and two rear legs mounted on the rear region for supporting said support member at a predetermined elevation above the ground; a drawing board; first connecting means for connecting the drawing board to the support member in a prostrate position relative to the latter; and second connecting means for connecting the drawing board to the support member in an upright position relative to the latter. A particular advantage of this construction is that the drawing board can be supported on the support structure in two different positions, one substantially horizontal or enclosing a small acute angle with the horizontal, and the other substantially vertical or enclosing a small acute angle with the vertical, so that the user of the drawing article of furniture can select that position which is best suited for his or her mood or for the particular drawing technique to be used.

The first connecting means advantageously includes at least one opening in the front region of the support member, and at least one projection on the drawing board which is received in the opening in the prostrate position of the board. It is further advantageous when the first connecting means further includes at least one slot at the rear region of the support member, and at least one tongue extending and introducible into the slot in direction from the rear to the front. The support member may have at least one protuberance at its rear region on which the drawing board is supported in a slightly incined position, and the slot may be provided at the region of this protuberance or in the same.

The article of furniture according to the present invention may advantageously further include a tray, particularly such including a plurality of compartments, and means for attaching the tray to the drawing board. Such attaching means advantageously includes at least one recess in at least one of the lateral sections of the drawing board, and at least one projection on the tray fittingly received in the recess in the attached condition of the tray. An especially simple, advantageous construction is obtained when the lateral section is provided with a ridge at the bottom of the recess as considered in the direction of introduction of the tray projection into the drawing board recess, and when the projection has a tab which engages behind the ridge in the assembled condition. Thus, the tray must be manipulated in a certain way before being detached from the drawing board, which eliminates the possibility that the tray could be accidentally knocked off.

According to another advantageous aspect of the present invention, the rear legs include internal and external sections which are telescopically extendable, the internal sections serving as at least a component of the second connecting means when extended to a predetermined distance out of the external sections and above the plane of the support member. For the purpose of passage of the internal leg sections therethrough, the support member is provided with through openings at the rear corner regions thereof. Then, the arresting means further includes means for arresting the internal sections in their extended positions, such as openings in the internal sections and arresting members, preferably mounted in the aforementioned protuberances, for sliding into and out of the openings of the internal leg portions in their extended positions, the arresting members being urged toward their extended or engaging positions by respective springs. Then, the upper portion of the drawing board can rest on those portions of the internal sections of the rear legs which are remote from the support member. The aforementioned tray may also form a part of the second connecting means when the drawing board is to be held in its upright position. For this purpose, the tray is provided at its bottom wall with a plurality of projections which engage in corresponding openings or recesses of the front region of the support member, and the projection which extends from the rear wall of the tray and which has been discussed above as attaching the tray to the lateral section of the drawing board is provided with a nose, while the front section of the drawing board is provided with two recesses associated with the rear projection, one of such recesses partially receiving the rear projection of the tray, and the other recess receiving the nose thereof. At least one of the bottom projection is constructed as a tongue which is received in a correspondingly configurated slot-shaped opening of the support member and engages behind a wall portion in the connected position of the tray. Thus, once again, certain manipulation of the drawing board and of the tray is necessary before it is possible to detach the same from one another and from the support member. The upper or remote ends of the internal sections of the rear legs are advantageously received in correspondingly configurated pockets of the rear section of the drawing board.

The drawing board may further have an embellishing accessory attached thereto at the rear section thereof. The means for attaching this accessory is so constructed as to permit attachment thereof to the drawing board in two different orientations, in one of which the accessory extends substantially normal to, and in the other substantially along the plane of the drawing board. This attaching means is preferably constituted by at least one, but preferably two, recesses of undercut configurations in the rear section of the drawing board, and at least one projection on the accessory having an enlarged portion which is fittingly received in the respective recess. The drawing board may further include at least one additional accessory, which may be thematically corellated to the one accessory, this additional accessory being equipped with a pin which is snugly received in a corresponding opening of the rear section of the drawing board.

The drawing board has a particularly advantageous construction when it consists of a frame including the aforementioned front, rear and lateral sections and provided with a recessed ledge which extends into the space surrounded by such sections, and a slate board which rests on the ledge. To hold the slate board on the ledge of the mounting frame, the latter is provided, at its region of merger of the front section with the lateral sections thereof, with holding members which confine the corners of the slate board between themselves and the ledge. Here again, the slate board is to be manipulated in a certain way before it can be lifted off the mounting frame. To facilitate this particular manipulation, at least one depression is formed in at least one of the lateral sections of the mounting frame, this depression permitting for the engagement of a marginal zone of the slate board, from the side or even from underneath, by the finger of a prospective user.

The slate board itself may be written or drawn on. For this purpose, the slate board is provided with at least a layer which is compatible with chalk, i.e. it permits chalk to adhere thereto. This layer also is water impermeable to prevent water used in washing off any previously written or drawn images from the impermeable layer from penetrating into the interior of the slate board and from causing the latter to warp. However, it may also be desired to use the drawing article of furniture for drawing or painting images on sheet-shaped record or image carriers, such as on paper sheet. For this purpose, the drawing board is provided at its rear section with a pair of clamping portions which confine a portion of the sheet between themselves and the rear section and thus hold the sheet in a position in which it at least partially covers the slate board.

The novel features which are considered as characteristic of the invention are set forth in particular in the appended claims. The improved article of furniture itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a perspective view showing the components illustrated in FIG. 1 in their assembled condition in which they form the drawing desk;

FIG. 3 is a sectional view taken on line 3—3 of FIG. 2;

FIG. 4 is a sectional view taken on line 4—4 of FIG. 2;

FIG. 5 is a sectional view taken on line 5—5 of FIG. 2;

FIG. 6 is a sectional view taken on line 6—6 of FIG. 2;

FIG. 7 is a sectional view taken on line 7—7 of FIG. 2;

FIG. 8 is a sectional view taken on line 8—8 of FIG. 2;

FIG. 9 is a sectional view taken on line 9—9 of FIG. 2;

FIG. 10 is a sectional view taken on line 10—10 of FIG. 9;

FIG. 11 is a view similar to FIG. 1 but showing the components in orientations assumed thereby when assembled as an easel;

FIG. 12 is a rear perspective view of a fragment of the drawing board as mounted on the end portion of an internal section of a telescopically extendable rear leg;

FIG. 13 is a rear elevational view of a larger fragment including the region of FIG. 12

FIG. 14 is a view similar to that of FIG. 2 but with the components assembled to form an easel;

FIG. 15 is a sectional view taken on line 15—15 of FIG. 14;

FIG. 16 is a sectional view taken on line 16—16 of FIG. 14;

FIG. 17 is a sectional view taken on line 17—17 of FIG. 14;

FIG. 18 is a sectional view taken on line 18—18 of FIG. 14; and

FIG. 19 is a broken-away bottom view of a detail of the assembly of a leg to the support frame of the article of furniture of FIG. 1.

DETAILED DESCRIPTION OF THE PREFERRED EMBODIMENT

Figure 1:
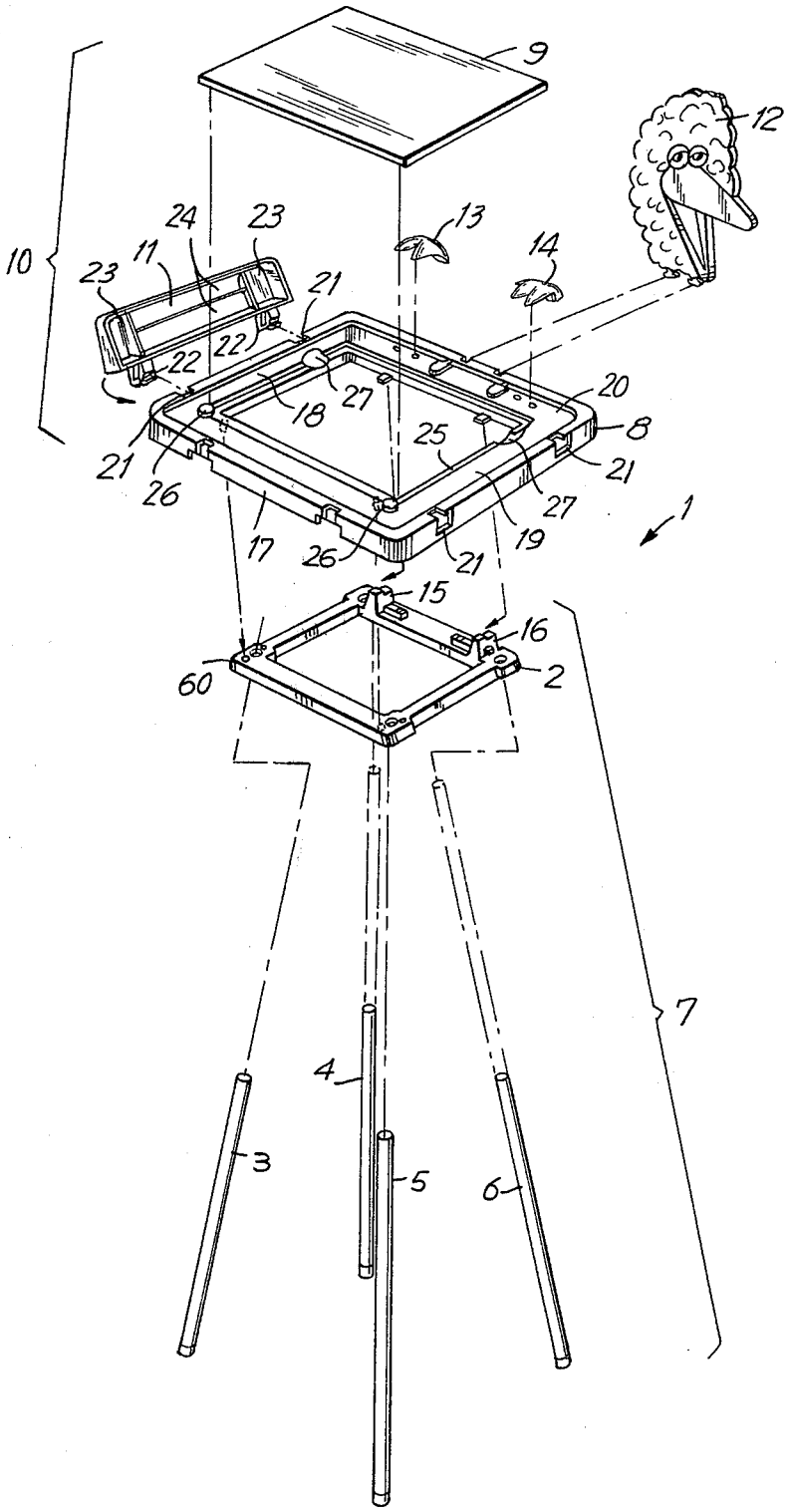
FIG. 1 is an exploded perspective view of the article of furniture in accordance with the present invention with the various components thereof assuming such orientations as they have when the article of furniture is assembled as a drawing desk.

Referring now to the drawing in detail, and first to FIG. 1 thereof, it may be seen that the reference numeral 1 has been used therein to identify an article of furniture in accordance with the present invention in its entirety. The article of furniture 1, which will be hereafter referred to as assembly, is shown in FIG. 1 in its disassembled state but with the various components oriented in the same manner as they are in the assembly 1 when the latter is set up as a drawing desk. The assembly 1 includes, as its main components, a support frame 2, four legs 3, 4, 5 and 6 which can be connected to the support frame 2 at the corners of the latter so as to form a support structure 7 therewith, a mounting frame 8 adapted to be supported on the support structure 7 in a manner which will be discussed in more detail later on, and a slate board 9 adapted to be mounted on the mounting frame 8 in a manner which will also be discussed in more detail below. The mounting frame 8 and the slate board 9 together constitute a drawing board 10. It is to be mentioned that, when referring to the slate board 9, reference is being had to the properties of such board, not necessarily to the material thereof. In other words, the slate board 9 need not be made of slate, so long as the element 9 has a plate-shaped configuration and at least one of its major surfaces will hold a layer of chalk until wiped or washed away and will prevent moisture from propagating into the interior of the element 9 where it could cause warping of or other damage to the element 9. As a matter of fact, such slate boards are nowadays rarely, if ever, made of slate and usually they are made of plastic-coated cardboard or particle board.

The assembly 1 also includes certain accessories which serve either for facilitating the use of the assembly 1, or to embellish the same and make the same more esthetically appealing. A useful accessory is a tray 11 which, in the position indicated in FIG. 1, forms a part of the drawing board 10. However, as indicated in FIG. 11, the tray 11 may also be mounted, as will be explained in more detail later, on the support frame 2 and, in this position, it forms a part of the support structure 7. In the embellishing category, the assembly 1 includes the head and the paws or hands of a character or person, especially of a fictitious one having pronounced appeal to the ultimate users, that is, children. For purposes of illustration, there has been used the character of Big Bird as known from the television program Sesame Street (Trademark). However, it will be appreciated that the image of any other character or person, whether actual or imaginary, may be used as well, and that other embellishing elements or formations may be used instead. The head has been indicated by the reference numeral 12, and the paws by the reference numerals 13 and 14. The assembly 1 is shown in FIG. 2 in its assembled condition in which it serves as a drawing or writing desk.

Coming now back to FIG. 1, it may be seen that the support frame 2 includes two protuberances 15 and 16 which, among other functions, serve for supporting the drawing board 10 on the support structure 7 in the position illustrated in FIG. 2 in which the drawing board 10 is slightly inclined downwardly in the frontward direction as considered from the viewpoint of a properly positioned prospective user of the assembly 1.

The mounting frame 8 has a front section 17 which rests on the support frame 2 in the aforementioned inclined position, two lateral sections 18 and 19, and a rear section 20 which is supported on the protuberances 15 and 16 in the inclined position in a manner yet to be discussed. Each of the lateral sections 18 and 19 is provided with a pair of recesses 21 which receive compatibly configurated projections 22 of the tray 11 when the latter is mounted on the mounting frame 8 and which are so configurated as to prevent the tray 11 from falling off or being accidentally knocked off the mounting frame 8 once mounted thereupon. In other words, the projections 22 and the recesses 21 are so configurated that a conscious effort has to be made by the user to detach the tray 11 from the mounting frame 8. The tray 11 has a plurality of differently shaped compartments 23 and 24, of which, for instance, the compartments 23 may be used to hold a quantity of water, one of the compartments 24 for holding watercolor dyes, and the other compartment 24 for accommodating brushes, pencils, crayons or the like. The mounting frame 8 further includes a ledge 25 which is recessed with respect to the top surface of the remainder of the mounting frame 8 by a distance preferably substantially corresponding to the thickness of the slate board 9. As illustrated, the ledge 25 extends around the entire inner circumference of the mounting frame 8; however, it could also consist of a plurality of individual sections spaced around the inner circumference. The ledge 25 serves to support the slate board 9 in a recessed fashion on the mounting frame 8, while the surfaces of the remainder of the mounting frame which extend from the top surface of the mounting frame 8 to the ledge 25 prevent movement of the slate board 9 in the plane of the mounting frame 8, except for a small play which is needed for assembling the slate board 9 with the mounting frame 8 and for disassembling the same. At the corners where the front section 17 of the mounting frame 8 meets with the lateral sections 18 and 19, the mounting frame 8 is provided with holding members 26 which extend over the ledge 25 and have a spacing therefrom which slightly exceeds the thickness of the slate board 9. The holding members thus confine the frontward corners of the slate board 9 between themselves and the ledge 25, and thus prevent accidental dissociation of the slate board 9 from the mounting frame 8 at these regions. The mounting frame 8 is further provided with depressions 27 in the lateral sections 18 and 19, which permit the user of the assembly 1 to engage the slate board 9 from the sides or from below by inserting fingers into the depressions 27.

FIGS. 3 to 10 illustrate details of the features that have been discussed above in general terms. So, for instance, FIG. 3 shows how the tray 11 is mounted on the lateral section 18 of the mounting frame 8, and how the slate board 9 is supported on the ledge 25. More particularly, the respective projection 22 is received in the recess 21, and it has a tab 28 which engages behind an associated ridge 29 of the lateral section 18. Hence, before it is possible to dissociate the tray 11 from the mounting frame 8, it is necessary to discontinue the engagement of the tab 28 behind the ridge 29, which requires that the tray 11 be first turned to a limited degree in the clockwise direction as seen in FIG. 3, until the tab 28 clears the ridge 29. Thus, accidental dissociation of the tray 11 from the mounting frame 8 is avoided. FIG. 3 also shows that the slate board 9 merely rests on the ledge 25. The slate board 9 is shown to include a backing layer 30, and an active layer 31 which has the above-discussed chalk-holding properties and which prevents moisture from penetrating therethrough to the backing layer 30.

FIG. 4 shows the details of the mounting of the slate board 9 at the front region of the mounting frame 8. As mentioned before, the slate board 9 rests on the ledge 25. The ledge 25 is shown to be discontinued underneath the holding member 26. The holding member 26 engages the slate board 9 from above, and thus confines the corner region of the slate board 9 between itself and the ledge 25. Thus, the slate board 9 will have to be lifted first at the corners remote from the holding members 26 before it is possible to pull the slate board 9 from between the ledge 25 and the holding members 26. The absence of the ledge 25 from underneath the holding member 26 facilitates the manipulation with the slate board 9 during its assembly with and disassembly from the mounting frame 8.

The manner in which the front section 17 of the mounting frame 8 is supported on the support frame 2 is shown in detail in FIG. 5. The front section 17 has a ridge 32 which rests on the top surface of the support frame 2. The support frame 2 has an opening 33 which receives a projecting pin 34 of the mounting frame 8. The opening 33 is somewhat larger than the pin 34 to permit limited rearward movement of the mounting frame 8 relative to the support frame 2.

The configuration of the depression 27 in the lateral section 19 of the mounting frame 8 is shown in FIG. 6. As seen therein, the depression 27 extends from the top surface of the lateral section 19 all the way to below the slate board 27 so that the fingers of the user can engage the slate board 9 not only at the side surfaces, but also from underneath.

FIG. 7 shows how the rear section 20 of the mounting frame 8 is supported on the protuberance 15 of the support frame 2. It may be seen that the protuberance 15 has a preferably slot-shaped opening 35 and that the rear section 20 has a tongue 36 which extends into and beyond the opening 35. Thus, the mounting frame 8 cannot be lifted off the support frame 2 at this region unless the mounting frame 8 is displaced rearwardly with respect to the support frame 2 to an extent which will remove the tongues 36 from the openings 35, which is preferably greater than that permitted by the openings 33 cooperating with the pins 34. In this manner, the mounting frame 8 is securely held on the support frame 2 unless and until an conscious effort is made to disassemble the same.

It is shown in FIG. 8 how the paw 14 is mounted on the rear section 20 of the mounting frame 8. For this purpose, the rear section 20 is provided with a through bore 37 which snugly receives a pin-shaped projection 38 of the paw 14. The dimensions of the bore 37 and of the projection 38 are preferably such that there is obtained an interference fit at this region, thus preventing the paw 14 from being accidentally knocked off the mounting frame 8.

FIGS. 9 and 10 show how the head 12 is mounted on the rear section 20 of the mounting frame 8 in the position illustrated in FIG. 2. The mounting frame rear section 20 is provided with an undercut recess 39, and the head 12 has two tongues 40 and 41 of which the tongue 40 rests on top of the rear section 20 and the tongue 41, which is enlarged with respect to a connecting portion 42 which interconnects the tongues 40 and 41, is received in the undercut portion of the recess 39. Thus, the head can be dismounted from the rear section 20 of the mounting frame 8 only by pushing the same rearwardly until the tongue 41 leaves the undercut recess 39.

As may be seen in FIGS. 11 and 14, the drawing board 10 can also be mounted on the support assembly 7 in a different position in which the assembly 1 constitutes an easel. To achieve this, the rear legs 4 and 6 are telescopically extendable in that they include external sections **4*a* and 6*a*, and internal sections 4*b* and 6*b* which can be fully or substantially fully accommodated in the respective external sections 4*a* and 6*a* but which can be pulled out of the external sections 4*a* and 6*a* and form continuations thereof upwardly of the support frame 2. To let the internal sections 4*a* and 6*a* pass therethrough, the support frame 2 is provided with through holes 43 which are situated next to the protuberances 15 and 16, respectively. As shown in FIG. 18, the respective internal section 4*b* is provided with a bore 44, and an arresting member 45 which has an arresting portion 46 and an actuating portion 47 and which is biased by a spring 48 towards its illustrated extended position, is movably mounted on the rear section of the support frame 2 for movement in the directions indicated by the double-headed arrow between the extended position and a retracted position. In the extended position, the arresting portion 46 is received in the bore 44 and thus holds the section 4*b* in position and prevents the same from descending into the section 4*a*. On the other hand, in the retracted position the arresting portion is withdrawn from the bore 44 so that the section 4*b*** is free to descend.

The upper portion of the section **4*b* abuts the rear section 20 of the mounting frame 8 assuming the position illustrated in FIG. 14, as shown in FIG. 15. This Figure also shows that the rear section 20 may be provided by at least one clamping portion 49, but preferably with at least two of such clamping portions 49, which is capable of confining a sheet of paper or similar material 50 between itself and the rear section 20 and thus of holding the sheet 50 in position, as shown in FIG. 14. To assure sufficient holding action, the clamping portion 49 is provided at its rear face with a ridge 51 which engages the sheet 50 and deforms the same substantially as illustrated in FIG. 15**.

The tray 11 is mounted on the support frame 2 in the manner shown in detail in FIG. 17. The front section of the support frame 2 is provided, in addition to the openings 33, with additional openings 52, and respective pin-shaped projections 53 extend from the bottom wall of the tray 11 to be received in the openings 53 of the support frame 2. In addition thereto, engaging tongues 54 extend from the bottom wall of the tray 11, and they extend into the openings 33 to engage behind the support frame 2 frontwardly thereof; only then can the projections 53 be introduced into the openings 52. Here again, a certain amount of skill is needed for attaching the tray 11 to and for detaching the same from the support frame 2, so that accidental detachment is out of the question. Consequently, the tray, when mounted on the support frame 2, forms a stationary or quasi-stationary part of the support structure 7 and can easily be used for supporting the drawing board 10 in its position illustrated in FIG. 11.

To this end, the projection 22 of the tray 11 is partially received in a recess 55 of the front section 17 of the mounting frame 8 and is provided with a nose 56 which extends into an opening 57 provided in the front section 17. In this manner, the front section 17 is firmly held in position with respect to the tray 11 and, via the same, with respect to the support frame 2.

As mentioned before, the rear section 20 of the mounting frame 8 is supported on the upper ends of the sections **4*b* and 6*b* of the legs 4 and 6 in the telescopically extended positions of the latter. In order to prevent lateral shifting of the drawing board 10 relative to the support structure 7 in the position shown in FIG. 14, the rear section 20 of the mounting frame 8 is provided, as shown in FIGS. 12 and 13, with partitioning walls 58 at its bottom, the partitioning walls 58 confining the upper ends of the leg sections 4*b* and 6*b*** between themselves.

As shown in FIG. 14, the head 12 forms a continuation of the mounting frame 8 in its plane when the drawing board 10 assumes the position of FIG. 14. For such mounting, the rear section 20 of the mounting frame is provided with a slot 58, as shown in FIG. 16, in which the enlarged tongue 41 is received to engage behind the wall of the rear section 20, while the tongue 40 again engages the external surface of such wall. The disassembly is the same as discussed above in connection with FIG. 10, except that the orientation is different.

Because of the above-discussed expedients, the assembly 1 can easily be disassembled for storage, transportation and similar purposes and assembled as easily, and yet, in its assembled condition, whether it be that shown in FIG. 2, or that illustrated in FIG. 14, it is very stable even when handled by a clumsy person, such as a child of tender years.

The stability is increased by securely mounting each leg 3, 4, 5 and 6 at the enlarged rectangular corners 60 of the support frame 2. As best seen in FIG. 19, the underside of a representative corner of the frame 2 is integrally formed with a plurality of radially-extending support ribs 62 which converge inwardly from the walls bounding each corner in radial direction towards the longitudinal axis of the respective leg. The inner edges of the support ribs at each corner are spaced away from each other along a circular path to define a circular recess in which a respective leg is snugly received with an interference-type fit. The inner edges frictionally and tightly engage each leg about its entire circumference to stabilize the assembly in either the FIG. 2 or FIG. 14 position.

It will be understood that each of the elements described above, or two or more together, may also find a useful application in other types of articles of furniture or similar arrangements differing from the type described above.

While the invention has been illustrated and described as embodied in a drawing desk convertible into an easel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, faily constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A convertible drawing article of furniture comprising, in combination, a support structure including a support member extending along a plane and having a front and a rear region, two front legs mounted on the front region and two rear legs mounted on the rear region of said support member for supporting the latter at a predetermined elevation above the ground; a drawing board; first connecting means for connecting said drawing board to said support member in a prostrate position relative to the latter, said first connecting means including at least one opening in said front region of said support member, and at least one projection on said drawing board received in said opening in said prostrate position; and second connecting means for connecting said drawing board to said support member in an upright position relative to the latter.

2. A convertible drawing article of furniture as defined in claim 1, wherein said first connecting means further includes at least one slot at said rear region of said support member, and at least one tongue extending and introducible into said slot in direction from the rear to the front.

3. A convertible drawing article of furniture as defined in claim 1, wherein said second connecting means further includes means defining a plurality of openings at said front region of said support member, a tray having a bottom and a rear wall, a plurality of projections on said bottom wall received in said openings when said tray assumes a connecting position relative to said support member, and at least one projection on said rear wall on which said drawing board rests in said upright position thereof.

4. A convertible drawing article of furniture as defined in claim 3, wherein said second connecting means further comprises a nose on said projection of said rear wall of said tray, a first recess in said drawing board for receiving said rear tray wall projection, and a second recess in said drawing board for receiving said nose of said rear tray wall projection.

5. A convertible drawing article of furniture as defined in claim 3, wherein at least one of said openings in said front region of said support member is configurated as a slot elongated in the front-to-rear direction; and wherein at least one of said bottom tray wall projections is configurated as an elongated tongue extending in the rear-to-front direction of said tray and engaging behind a wall portion adjacent to said slot in said connecting position.

6. A convertible drawing article of furniture as defined in claim 1, and further comprising at least one embellishing accessory to said drawing board, and means for attaching said accessory to said drawing board.

7. A convertible drawing article of furniture as defined in claim 6, wherein said drawing board includes a rear section having at least one recess; and wherein said attaching means includes at least one projection on said accessory received in said recess.

8. A convertible drawing article of furniture as defined in claim 7, wherein said recess has an undercut portion, and wherein said projection has an enlarged portion received in said undercut portion of said recess in an attached position of said accessory.

9. A convertible drawing article of furniture as defined in claim 8, wherein said accessory extends substantially normal to the plane of said drawing board when said projection thereof is received in said recess; and wherein said attaching means further includes at least one additional recess similar to said recess and dimensioned to receive said projection of said accessory in another attached position of the latter in which said accessory extends substantially along the plane of said drawing board.

10. A convertible drawing article of furniture as defined in claim 1, wherein said drawing board includes a mounting frame having a front and a rear section and lateral sections interconnecting said front and rear sections, a recessed ledge on said sections extending inwardly therefrom, and a slate board resting on said ledge.

11. A convertible drawing article of furniture as defined in claim 10, and further comprising holding members at the regions of merger of said front section with said lateral sections for holding the corner regions of said slate board in confinement between themselves and said ledge.

12. A convertible drawing article of furniture as defined in claim 10, and further comprising at least one depression in at least one of said lateral sections of said mounting frame for engaging the adjacent marginal portions of said slate board.

13. A convertible drawing article of furniture as defined in claim 1, wherein said first connecting means connects said drawing board to said support means in a prostrate position in which said drawing board encloses a small acute angle with the horizontal.

14. A convertible drawing article of furniture as defined in claim 1, wherein said drawing board includes a mounting frame having a front and a rear section and lateral sections interconnecting said front and rear sections, and a ledge on said sections extending therefrom into the space surrounded by such sections, and a slate board supported, in a recessed fashion, on said ledge.

15. A convertible drawing article of furniture as defined in claim 14, and further comprising a pair of holding members at the regions of merger of said front section with said lateral sections and confining the corner regions of said slate board between themselves.

16. A convertible drawing article of funriture as defined in claim 14, and further comprising at least one depressed portion of at least one of said lateral portions for engaging a marginal zone of said slate board.

17. A convertible drawing article of furniture as defined in claim 14, and further comprising at least one attachment and means for detachably mounting said attachment on said mounting frame.

18. A convertible drawing article of furniture as defined in claim 17, wherein said attachment is a tray having a plurality of compartments.

19. A convertible drawing article of furniture as defined in claim 17, wherein said attachment is an embellishing accessory.

20. A convertible drawing article of furniture as defined in claim 17, wherein said mounting means includes at least one recess in at least one of said lateral sections and delimited by a ridge, and at least one projection on said attachment and having a tab engaging behind said ridge in the mounted position of said attachment.

21. A convertible drawing article of furniture as defined in claim 17, wherein said mounting means includes at least one opening in said rear section, and a pin-shaped projection on said attachment which is snugly received in said opening in the mounted position of said attachment.

22. A convertible drawing article of furniture as defined in claim 17; and further comprising means for attaching a sheet-shaped carrier to said mounting frame so as to at least partially cover said slate board.

23. A convertible drawing article of furniture as defined in claim 22, wherein said attaching means includes at least two tongues projecting from said rear section of said mounting frame and adapted to clamp said carrier between themselves and said rear section.

24. A convertible drawing article of furniture comprising, in combination, a support structure including a support member extending along a plane and having a front and a rear region, two front legs mounted on the front region and two rear legs mounted on the rear region of said support member for supporting the latter at a predetermined elevation above the ground; a drawing board having a front section, a rear section, and lateral sections interconnecting said front and rear sections; a tray; means for attaching said tray to said drawing board, said attaching means including at least one recess in at least one of said lateral sections, and at least one projection on said tray fittingly received in said recess in the attached condition of said tray; first connecting means for connecting said drawing board to said support member in a prostrate position relative to the latter; and second connecting means for connecting said drawing board to said support member in an upright position relative to the latter.

25. A convertible drawing article of furniture as defined in claim 24, wherein said one lateral section has a ridge at the bottom of said recess as considered in the direction of introduction of said projection of said tray into said recess; and wherein said projection has a tab which engages behind said ridge in said attached condition.

26. A convertible drawing article of furniture comprising, in combination, a support structure including a support member extending along a plane and having a front and a rear region, two front legs mounted on the front region and two rear legs mounted on the rear region of said support member for supporting the latter at a predetermined elevation above the ground; a drawing board; first connecting means for connecting said drawing board to said support member in a prostrate position relative to the latter; and second connecting means for connecting said drawing board to said support member in an upright position relative to the latter, said second connecting means including internal sections which are telescopically receivable in said rear legs and which are extendable to a predetermined distance out of said rear legs into extended positions relative thereto, said support member having openings therein for the passage of said internal sections in said extended positions therethrough to above said support member, said second connecting means further including means for arresting said internal sections in said extended positions thereof, and means on said drawing board for resting on those ends of said internal sections which are remote from said rear legs in said extended positions.

27. A convertible drawing article of furniture as defined in claim 26, wherein said resting means includes means for bounding respective pockets on said drawing board for receiving said remote ends of said internal sections.

28. A convertible drawing article of furniture as defined in claim 26, wherein said arresting means includes, for each of said internal sections, an aperture in the respective section, and an arresting member mounted on said support member for movement between a retracted and an extended position and having an arresting portion received in the respective aperture in said extended position.

29. A convertible drawing article of furniture as defined in claim 28, wherein said support member has a protrusion adjacent to each of said openings; and wherein said arresting members are respectively mounted in said protrusions for sliding between said retracted and extended positions.

30. A convertible drawing article of furniture as defined in claim 29, and further comprising spring means for biasing said arresting member toward said extended position thereof.

* * * * *